US005764190A

United States Patent [19]

Murch et al.

[11] Patent Number: 5,764,190

[45] Date of Patent: Jun. 9, 1998

[54] CAPACITIVELY LOADED PIFA

[75] Inventors: Ross David Murch; Corbett Ray Rowell, both of Kowloon, Hong Kong

[73] Assignee: The Hong Kong University of Science & Technology, Hong Kong

[21] Appl. No.: 679,978

[22] Filed: Jul. 15, 1996

[51] Int. Cl.[6] ..... H01Q 1/24

[52] U.S. Cl. ..... 343/702; 343/700 MS; 343/752

[58] Field of Search ..... 343/702, 700 MS, 343/713, 866, 752, 749; H01Q 1/24, 1/38

[56] References Cited

U.S. PATENT DOCUMENTS 5,006,859 4/1991 Wong et al. ..... 343/830
5,148,181 9/1992 Yokoyama et al. ..... 343/702
5,291,210 3/1994 Nakase ..... 343/713
5,434,579 7/1995 Kagoshima et al. ..... 343/700 MS
5,526,003 6/1996 Ogawa et al. ..... 343/713

FOREIGN PATENT DOCUMENTS

604338A1 6/1994 European Pat. Off. ..... H01Q 1/24

*Primary Examiner*—Hoanganh T. Le
*Attorney, Agent, or Firm*—Burns, Doane, Swecker & Mathis, LLP

[57] ABSTRACT

A planar inverted-F antenna is described that is provided with a capacitive load that allows the dimensions of the antenna to be reduced from a conventional λ/4 to λ/8. To maintain good bandwidth and impedance matching in spite of the presence of the capacitive load, a capacitive feed is also provided.

17 Claims, 10 Drawing Sheets

CAPACITIVELY LOADED PIFA

FIELD OF THE INVENTION

This invention relates to a planar inverted-F antenna (PIFA), and in particular to a design for such a PIFA that allows the PIFA to be compact and suitable for use in small cellular handsets.

BACKGROUND OF THE INVENTION

In recent years the demand for small cellular handsets has grown substantially and the need for still smaller handsets continues to increase. The handset size, however, is limited by the battery and the size of the antenna. In addition the need to employ antenna diversity on the handset to improve receiver performance through the use of multiple antennas on the handset increases still further the need for small antennas. In the past few years PIFA designs have received attention for such applications since they are compact (approximately $\lambda/4$ in length) and can be further optimised by the use of strategically placed loads.

PRIOR ART

U.S. Pat. No. 5,434,579 (Kagoshima et al) is concerned with a PIFA and in particular with a structure for feeding the antenna signal and solving certain problems that occur with a direct feed to the antenna plate. To solve these difficulties a non-contact feed is described with a dielectric material located between the antenna plate and a ground plate. U.S. Pat. No. 4,907,006 (Nishikawa et al) describes a PIFA in which a sub-radiator plate is located not directly between the radiator plate and the ground plate but is mounted on the ground plate in close proximity to the radiator plate. In both these documents however antennas are disclosed with a maximum dimension that is $\lambda/4$ and there remains a need for a smaller antenna.

SUMMARY OF THE INVENTION

According to the present invention there is provided an antenna device, comprising:

(a) a first conductor plate forming a transmission plate and having first and second ends, (b) a second conductor plate disposed below and arranged approximately in parallel with the first conductor plate and forming a ground conductor of the antenna device, (c) means for electrically connecting the first conductor plate with the second conductor plate, and (d) a capacitive load connected between the second said end of said first conductor plate and said second conductor plate.

With this arrangement a small antenna design is possible. The design is effectively a PIFA with a capacitive load which allows the overall length of the antenna to be reduced to $\lambda/8$. A difficulty with providing such a capacitive load, however, is that it reduces the bandwidth of the antenna and thus makes signal matching more difficult.

In a particularly preferred embodiment therefore a capacitive feed is provided that allows the input impedance to be adjusted for easier matching. This capacitive feed may take the form of a third conductor plate electrically connected to the second conductor plate and being spaced from and parallel to the first conductor plate at a location between the first and second ends of the first conductor plate.

The capacitive load may comprise a conductor plate electrically connected to the second said end of said first conductor plate and being spaced from and parallel to said second conductor plate. Alternatively the capacitive load may comprise a pair of parallel plates, one connected to the second said end of said first conductor plate and the other being electrically connected to said second conductor plate.

The means for electrically connecting the first and second conductor plates may be located at any convenient point, but one particularly preferred method is to provide an electrical connection at a first said first conductor plate to said second conductor plate.

Furthermore in order to reduce still further the size of the antenna a dielectric filling may be used either between the capacitive plates of the capacitive load or filling the space between the first conductor plate and the second conductor plate.

If a capacitive feed is to be used two types of dielectric may be employed. One dielectric may be located between the first conductor plate and the third conductor plate, or a dielectric may be located between the third conductor plate and the second conductor plate.

The conductor plates may be of any convenient shape and may if desired incorporate slots which serve to widen the bandwidth, provide multi-resonance or to reduce antenna length. Alternatively the plates may be replaced by wires and in this specification the term "plate" is deemed to include "wire".

BRIEF DESCRIPTION OF THE DRAWINGS

Some embodiments of the inventions will now be described by way of example and with reference to the accompanying drawings, in which.

DETAILED DESCRIPTION OF PREFERRED EMBODIMENTS

Figure 1:
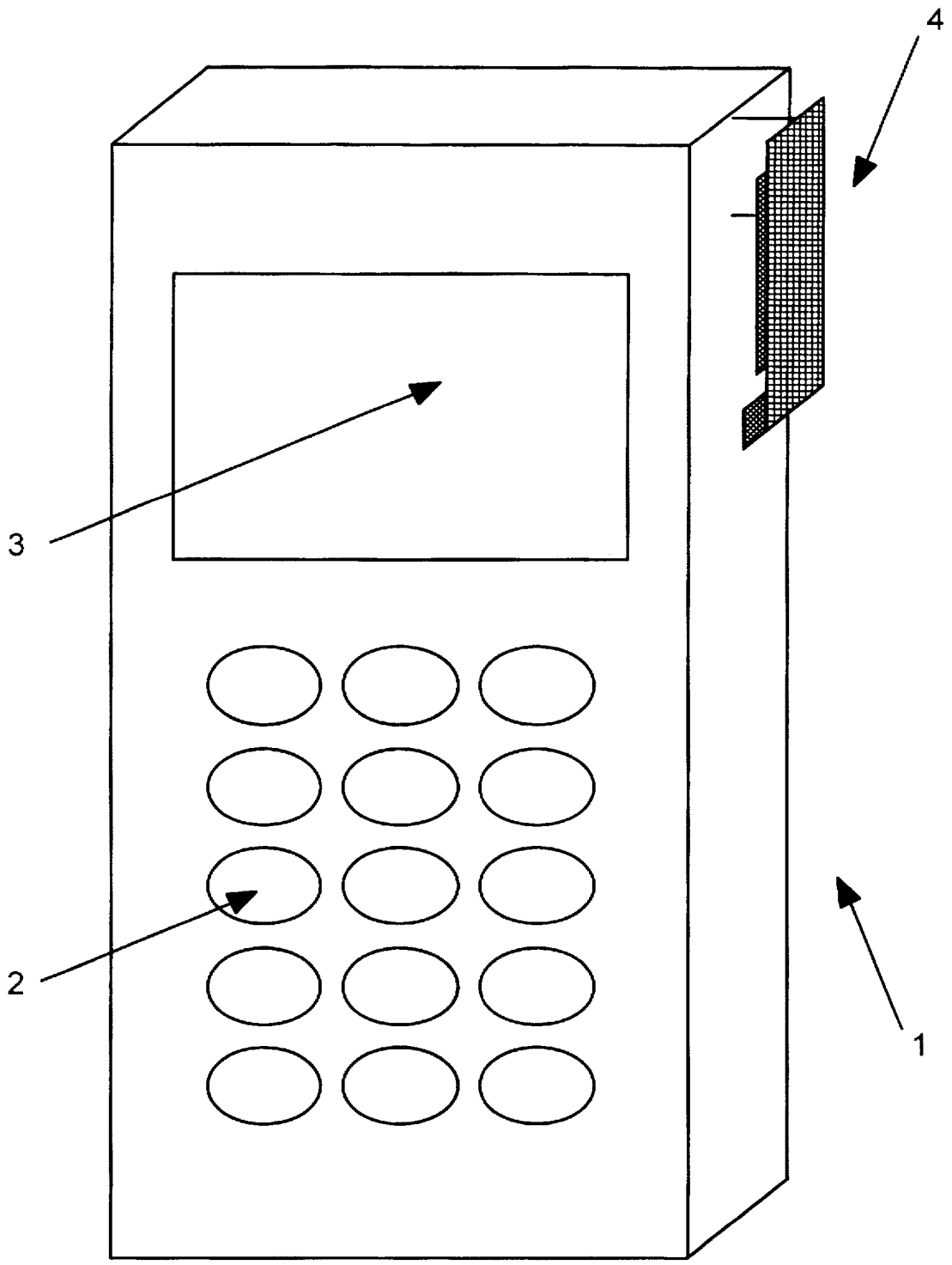
FIG. 1 is a perspective view of a mobile phone handset incorporating an antenna of an embodiment of the invention.

FIG. 1 shows a mobile telephone handset 1. The handset 1 includes a keypad 2 and a display panel 3 in a conventional manner. Although the size of the handset may vary a typical sized handset would be a generally rectangular cuboid of approximately 80 mm height, 40 mm width, and 10 mm thickness. A receiving and broadcasting antenna 4 is located at a convenient position on the handset and may preferably be shielded from accidental damage by a structure made of a material transparent to the wavelength used for communication.

Figure 2:
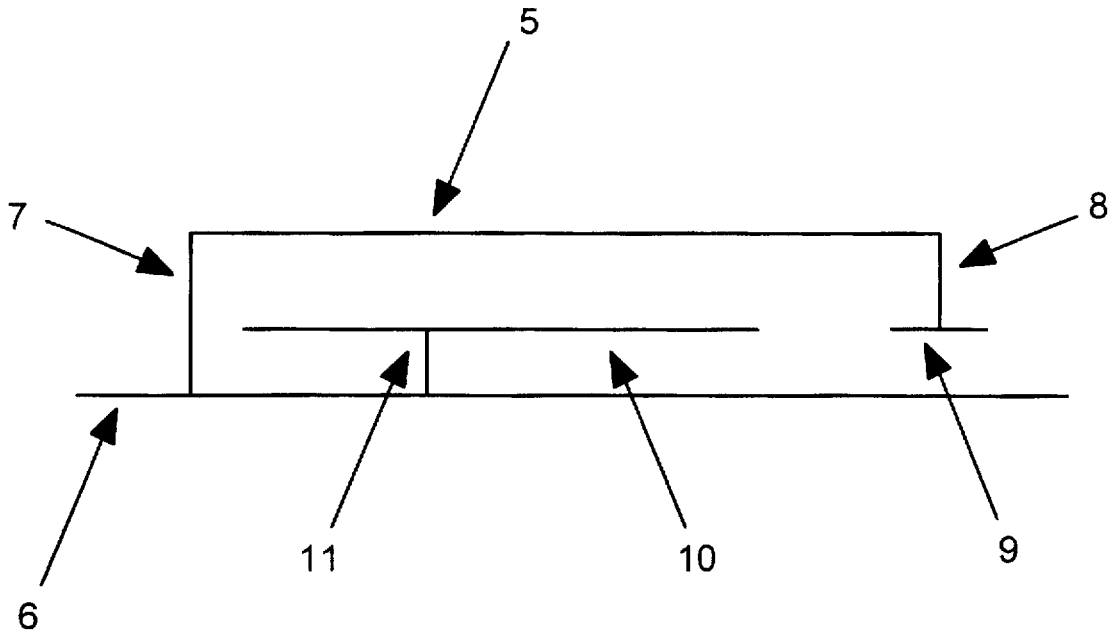
FIG. 2 is a side view of the antenna of the handset of FIG. 1
Figure 3:
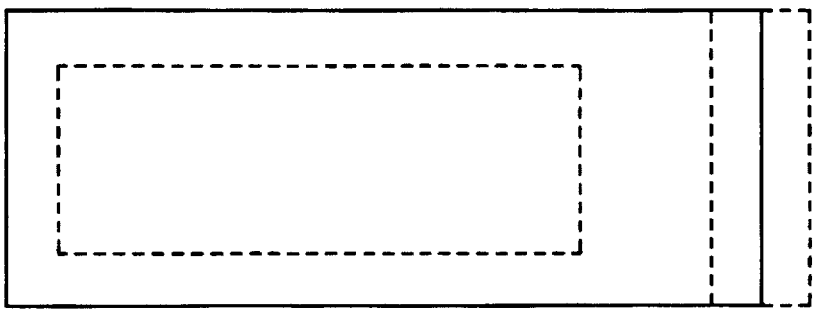
FIG. 3 is a top plan view of the antenna of FIG. 2

The structure of the antenna 4 is shown in more detail in FIGS. 2 & 3. The antenna 4 comprises a first conductor plate 5 spaced from but parallel to a second conductor plate 6. The second conductor plate is a ground plate and may in fact comprise the casing of the handset 1. Typically the first conductor plate 5 is a rectangular plate 25 mm long and 10 mm wide spaced from the second plate 6 by a distance of 5 mm.

The first conductor plate 5 has first and second ends. At a first said end the first conductor plate is connected to the second plate 6 by a conductor 7. At the second end of the first conductor plate 5 there is provided a second conductor 8 extending toward but not reaching the second conductor plate 6. Another way of viewing this is to regard the open end of the PIFA as being folded toward the ground plane. At the end of this second conductor 8 is provided a third conductor plate 9 spaced from but parallel to the second conductor plate 6 which forms therewith a capacitive load. This third conductor plate is preferably 4 mm long and 10 mm wide and is spaced from the second conductor plate 6 by 0.5 mm.

The third conductor plate in conjunction with the second - ground - conductor plate 6 serves as a capacitive load which as will be explained further below allows the antenna to be reduced in size in comparison with existing PIFA designs. However the capacitive load does introduce difficulties in terms of impedance matching and bandwidth and to mitigate this problem it is preferable to provide a capacitive feed. This may be achieved by providing a fourth conductor plate 10 located between the first and second conductor plates 5,6 at a location between the first and second ends of the first conductor plate 5 and electrically connected by conductor 11 (6 mm from conductor 7) to the second conductor plate 6. Such a fourth conductor plate 10 is shown in FIGS. 2 & 3 and may be 23 mm long, 10 mm wide and spaced from the second conductor plate 6 by 2.5 mm. With these dimensions and geometry the resonant frequency is 1.58 GHz. Without the capacitive load a conventional PIFA of the same dimensions would have a resonant frequency of 2.48 GHz.

The properties of such an antenna can be modelled using finite difference time domain (FDTD) techniques (see for example (1) K. S. Kunz and R. J. Luebbers "*The Finite Difference Time Domain Method for Electromagnetics*" CRC Press (Boca Raton, Fla.) 1993 and (2) R. J. Luebbers, K. S. Kunz, M. Schneider, and F. Hunsberger "*A Finite-Difference Time-Domain Near Zone to Far Zone Transformation*" IEEE Trans. Antennas Propagat., 39(4):429–433, 1991). The FDTD program listed in (1) is modified for simulating antennas and a near to far transformation is employed using the method described in (2). The source is a Gaussian derivative of the general form $V_{source}=(-2\alpha(\tau-\beta\Delta t)e^{(-\alpha(\tau-\beta\Delta t))})$. To prevent numerical resonance, the source is modelled as a voltage source in series with a resistor. The resistor "absorbs" the stray current and the fields decay more rapidly, allowing for shorter simulations.

Figure 6:
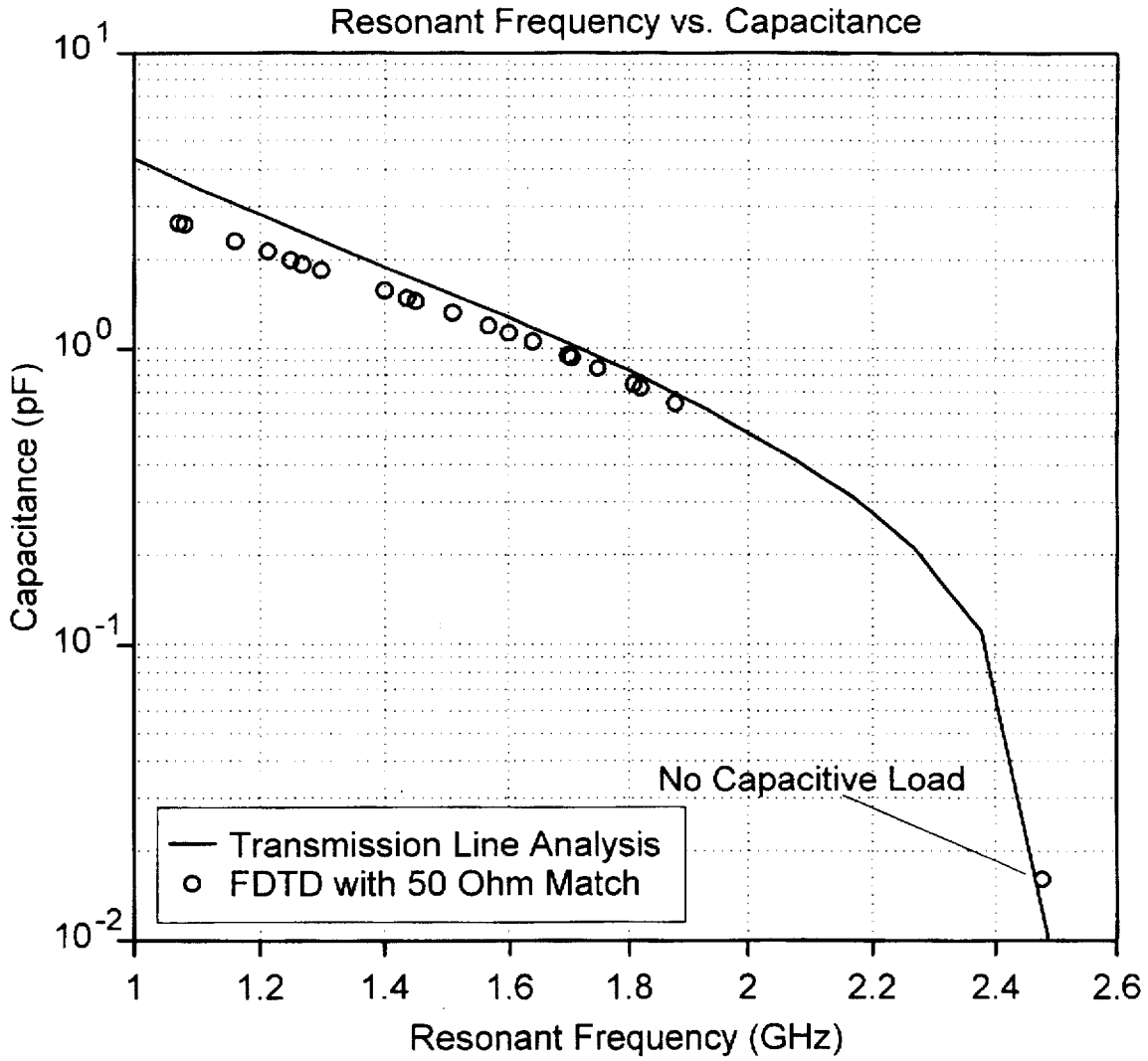
FIG. 6 is a plot showing the effect on the resonant frequency of varying the capacitive load.

The effect of the capacitive load may be seen by altering the capacitance width $W_{cap}$ (ie the width of the third conductor plate 9) and the plate separation $d_{cap}$ (ie the distance between the third conductor plate 9 and the ground plate 6) while maintaining a constant plate length of 10 mm. The results are shown in FIG. 6. As the capacitance increases (eg by either decreasing $1/d_{cap}$ or $W_{cap}$) the resonant frequency decreases. The effect of capacitance is nearly linear on the semi-log plot, except in the limiting case as the plate separation tends to zero. Thus for a given antenna size introducing a capacitive load allows the antenna to work at longer wavelengths. Conversely for a given wavelength, by including a capacitive load a smaller antenna can be constructed. FIG.6 also show that the change in the plate separation $d_{cap}$ has a greater effect on the resonant frequency than a change in the plate width $W_{cap}$.

Figure 7:
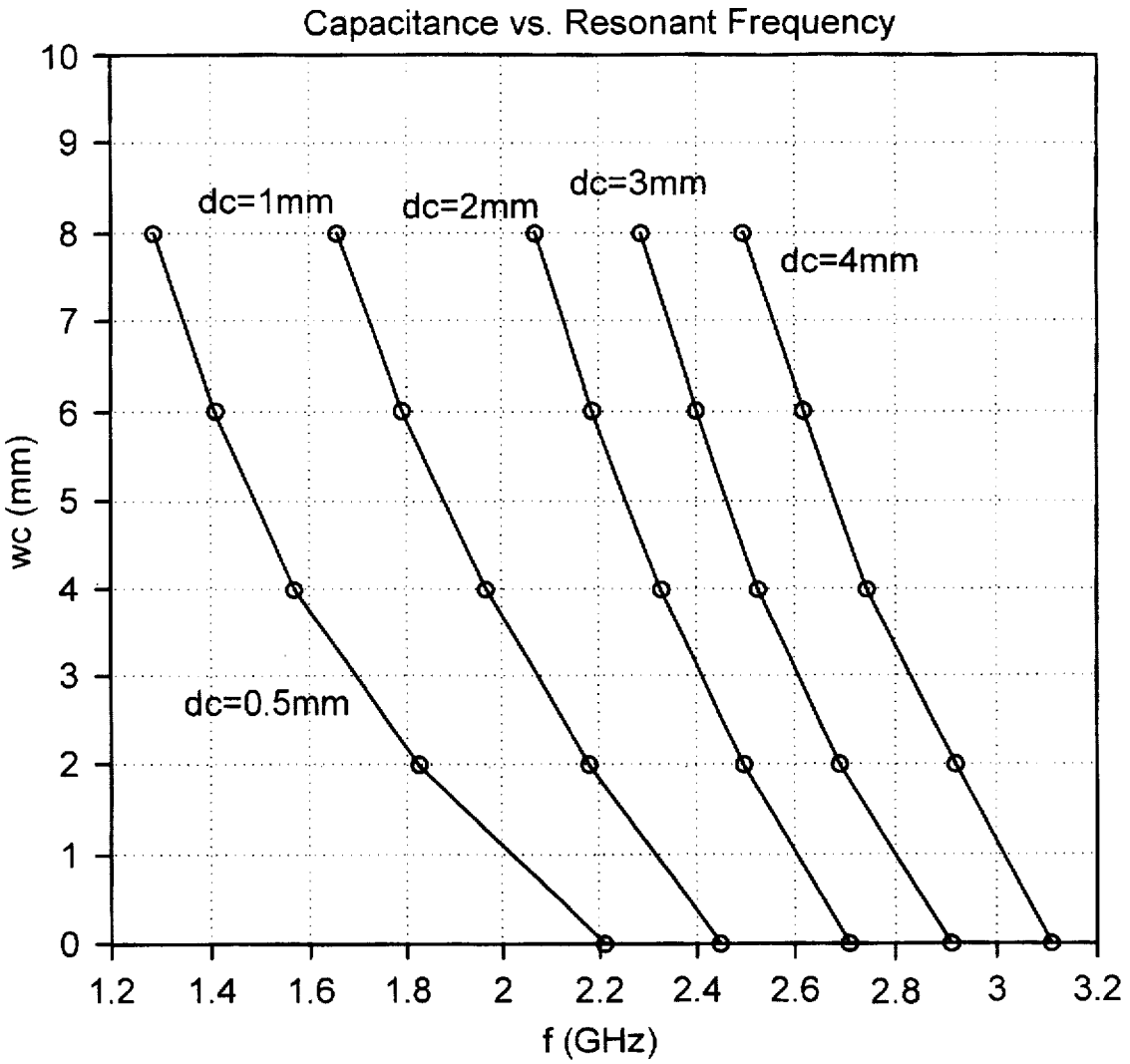
FIG. 7 is a plot showing the relative significance of plate width and spacing of the capacitive load on resonant frequency.

FIG. 7 shows the effect of changing $d_{cap}$ on the significance of the plate width $W_{cap}$. As $d_{cap}$ is increased from 0 mm to 4 mm the variation in width of the capacitor plate has a decreased effect on the resonant frequency.

Figure 8:
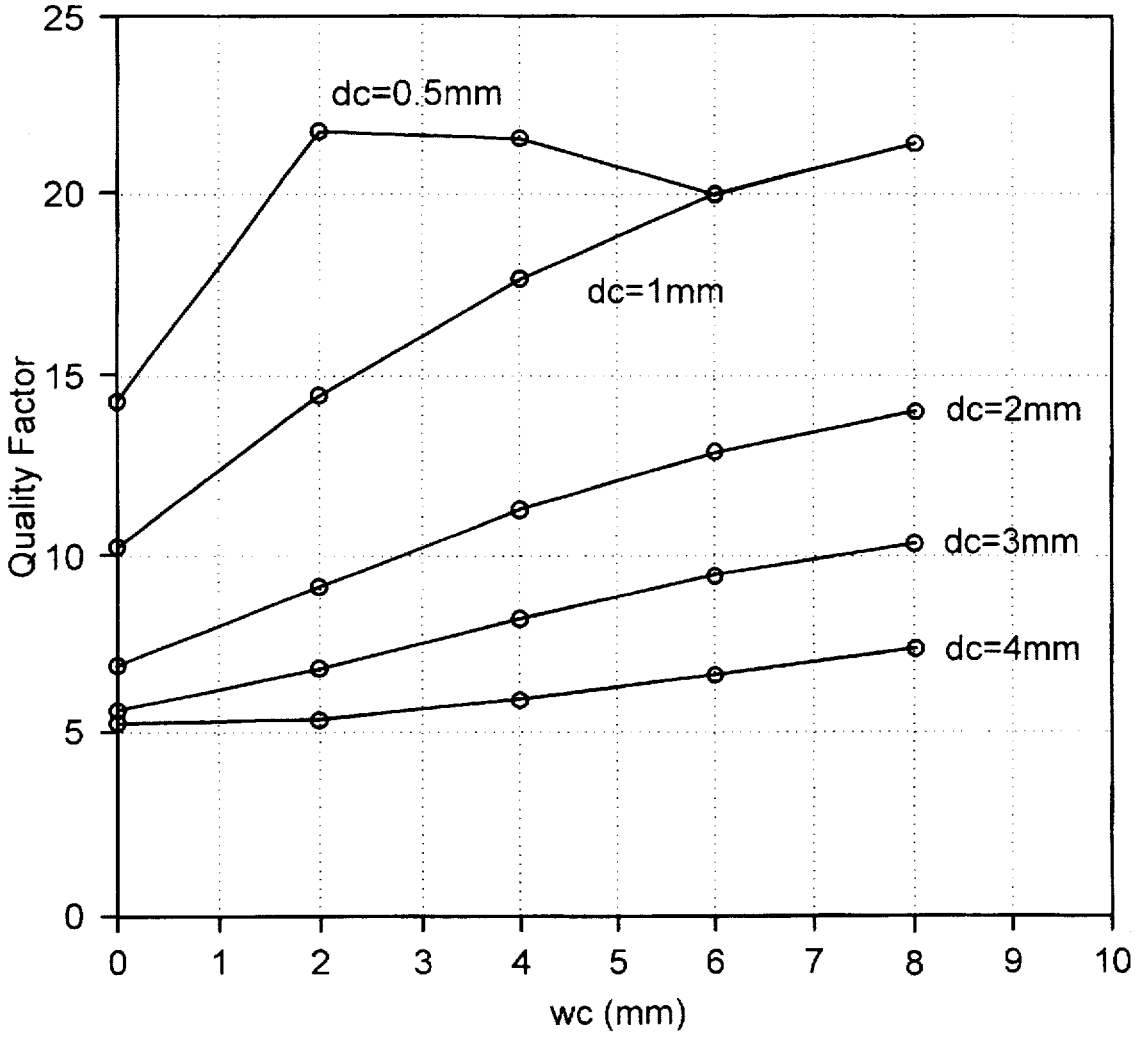
FIG. 8 is a plot showing the effect of the capacitive load on the Quality factor.

FIG. 8 illustrates the fact that the quality factor Q ($=f_{res}/\Delta f$) increases as the capacitive load is increased and hence the bandwidth is reduced. As with the resonant frequency the quality factor is more dependant on the plate separation than the capacitor plate width. As Q increases the bandwidth is lowered significantly and the resistance increases accordingly making it difficult to match the antenna to a conventional 50 Ωload. For this reason a capacitive feed is preferred.

By introducing another capacitor into the network as a capacitive feed the impedance characteristics can be manipulated until a proper match is made. The coaxial is connected to a fourth plate 10 located beneath the first conductor plate 5 (ie the radiator plate). The impedance characteristics are then controlled by varying the dimensions of the capacitive feed, the feed placement, and the distance separating the fourth plate 10 from the second conductor plate 6. As the distance between the two plates increases the peak values of both the resistance and the reactance curves are reduced. Furthermore the reactance curve is shifted vertically downward. By adjusting the area of the capacitive feed the vertical placement of the reactance curve can be adjusted. The resistance is unaffected unless the capacitive plate becomes larger than the second plate 6 and starts radiating. The horizontal placement or resonant frequency is unaffected by the capacitive plate.

The ability to effectively model the characteristics of such an antenna is important in antenna design. The precise geometry of the antenna will of course affect its resonant frequency and appropriate modelling allows an antenna design to be refined for a particular application, and also allows the effect of the provision of the capacitive feed to be carefully evaluated.

Figure 4:
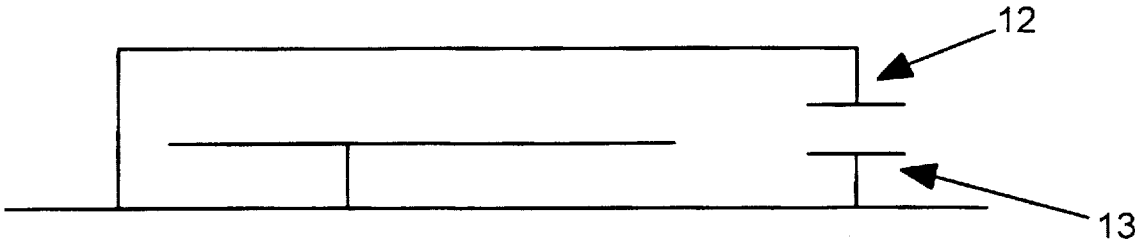
FIG. 4 is a side view corresponding to FIG. 2 but of a second embodiment.
Figure 5:
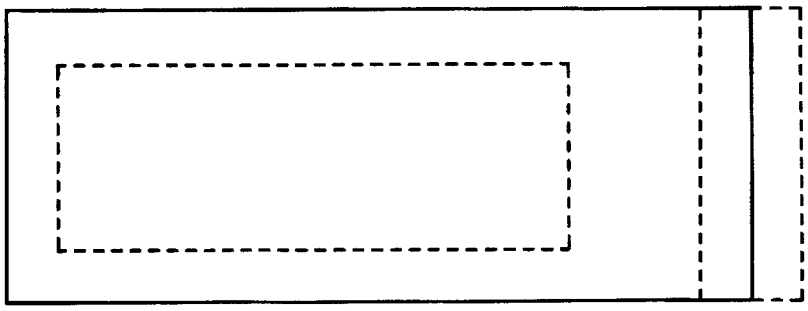
FIG. 5 is a top plan view corresponding to FIG. 3 but of the second embodiment.

FIGS. 4 & 5 show a second embodiment of the invention which differs from the first in its dimensions and in that the capacitive load comprises a pair of capacitor plates 12,13 rather than a single plate spaced from the second conductor plate 6. The first conductor plate 5 measures 25 mm in length and 6 mm wide and is spaced from the second plate 6 by 3 mm. The two capacitor third plates 12,13 are each 6 mm wide, 4 mm long and are separated by 1 mm. The fourth plate 10 (the capacitive feed plate) is 21 mm long and 4 mm wide spaced from the second plate 6 by 1.5 mm and connected to the second plate 6 by a coaxial 7 mm from the end of the second plate 6 that is connected to the first. With this configuration experimental results showed that the antenna had a resonant frequency of 1.78 GHz and the bandwidth for VSWR <2.0 was 91 MHz or 5%.

Figure 9:
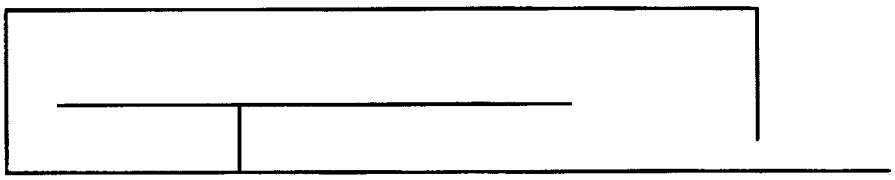
FIG. 9 is a side view corresponding to FIG. 2 but of a third embodiment.
Figure 10:
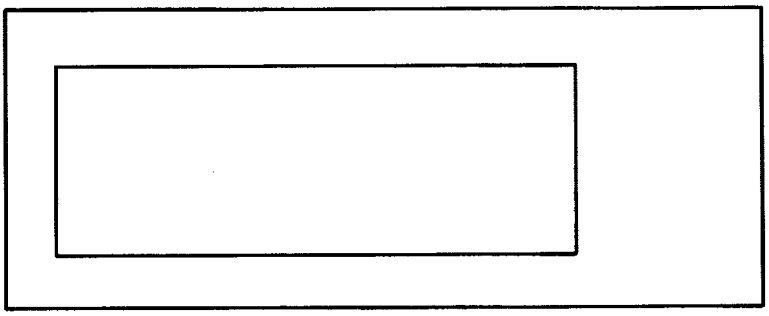
FIG. 10 is a top plan view corresponding to FIG. 3 but of the third embodiment.

FIGS. 9 & 10 illustrate a third embodiment of the invention that is particularly suitable for use in a personal communications system. By increasing the height and width of the antenna and reducing the capacitance in the capacitive load, an antenna suitable for operation in the Personal Communications Service (PCS) frequency band may be constructed. In this third embodiment a single plate capacitive load is utilized. The first conductor plate measures 20 mm in length and is 8 mm wide and is spaced from the second plate by 4 mm. The width of the capacitive plate is 8 mm. The capacitive load is separated from the second conductive plate by 0.4 mm. The fourth plate (ie the capacitive feed) is 18.4 mm long and 8 mm wide spaced from the second conductive plate by 2 mm and connected to the second conductive plate by a coaxial 5.6 mm from the shorted end of the first conductor plate. With this configuration, experimental results showed that the antenna had a resonant frequency of 1.78 Ghz and a bandwidth (VSWR <2) of 178 MHZ. The size may be further reduced by using slots in the first conductor plate or by constructing the antenna on a dielectric material.

Figure 11:
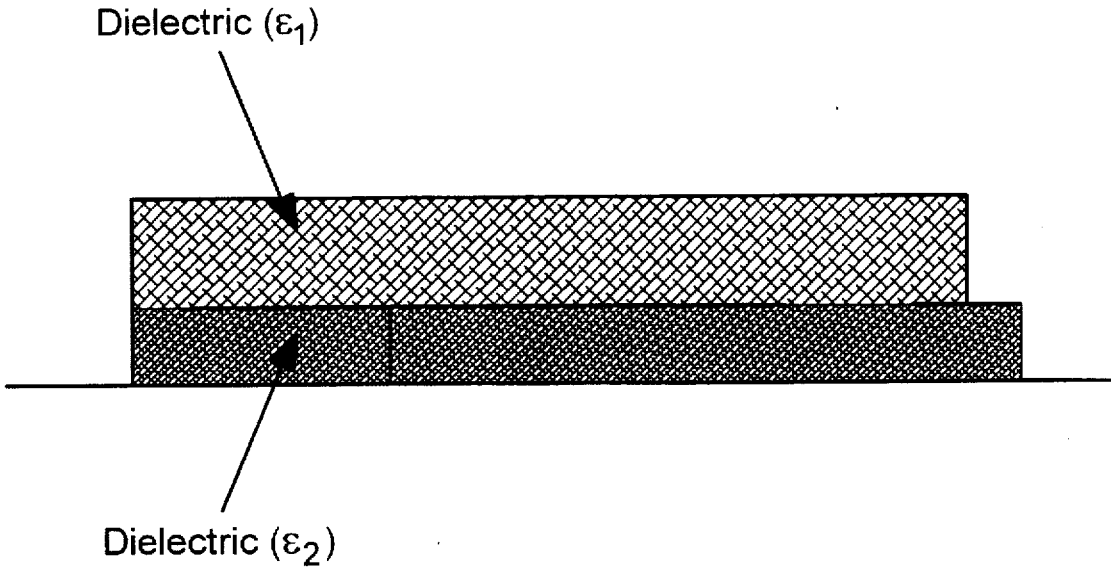
FIG. 11 is a side view showing a modification in which dielectric material is provided between the conductive plates.

The resonant frequency of the antenna may also be adjusted by the provision of one or more dielectric materials between the first and second plates. This is shown in FIG. 11 in which a first dielectric material $\epsilon_1$ is located between the capacitive feed plate and the first conductor, while a second dielectric material $\epsilon_2$ is located between the capacitive feed plate and the second plate. Of course only one of these dielectrics may be provided if desired, or $\epsilon_1$ may equal $\epsilon_2$, or either dielectric may simply be air.

Figure 12:
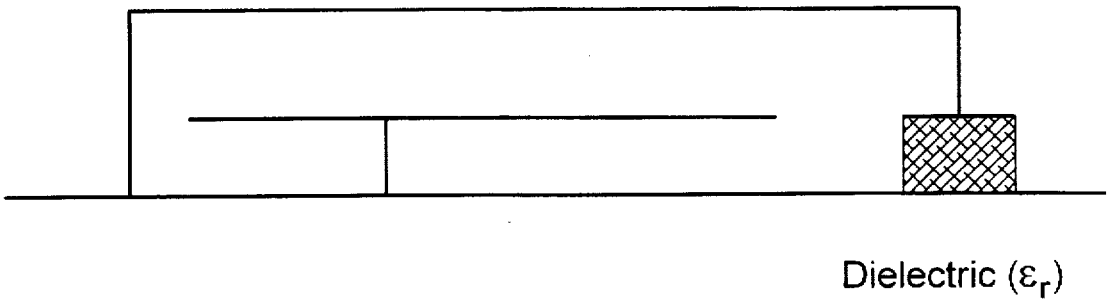
FIGS. 12 & 13 show modifications in which the capacitive load is provided with dielectric material, and FIGS. 14(*a*)–(*c*) show modifications in which slots are provided in the conductor plates to vary the resonant frequency.
Figure 13:
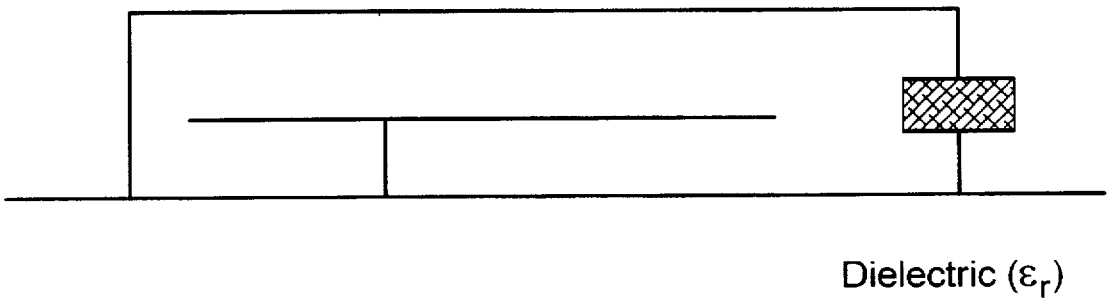

FIGS. 12 & 13 show another possibility in which a dielectric $E_r$ is located as part of the capacitive load (a single plate arrangement in FIG. 12 and parallel plates in FIG. 13).

Figure 14A:
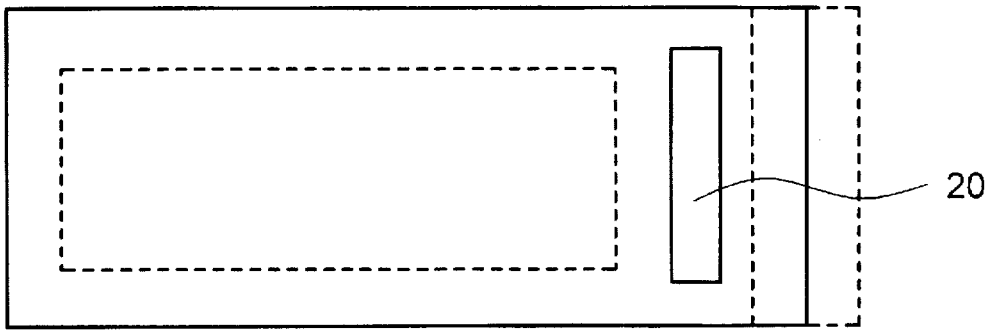
Figure 14B:
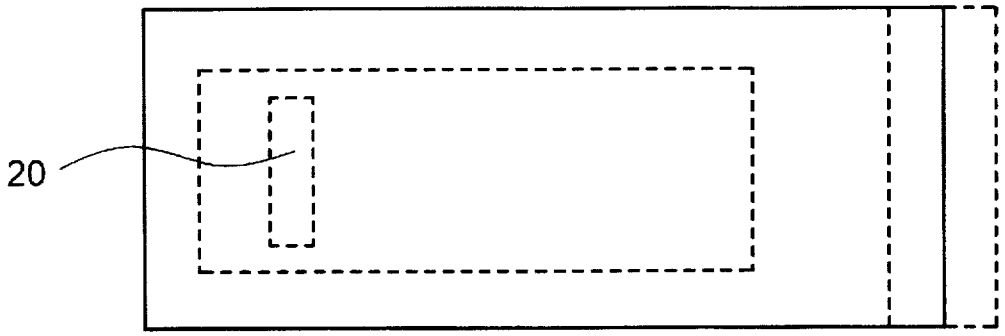
Figure 14C:
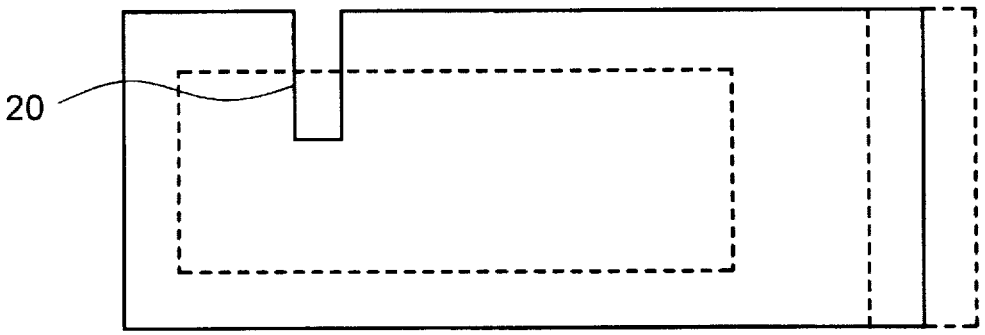

FIGS. 14(*a*)–(*c*) show how slots 20 can be provided in the various conducting plates. Slots can be used to vary a resonant frequency since the current has to travel a longer path. FIG. 14(*a*) shows a slot in the first conductor plate, FIG. 14(*b*) a slot in the fourth plate (the capacitive feed plate), and FIG. 14(*c*) shows a slot in the edge of the first plate.

We claim:

1. An antenna device, comprising:

(a) a first conductor plate forming a transmission plate and having first and second ends, (b) a second conductor plate disposed below and arranged approximately in parallel with the first conductor plate and forming a ground conductor of the antenna device, (c) means for electrically connecting the first conductor plate with the second conductor plate, (d) a capacitive load connected between the first end of said first conductor plate and said second conductor plate and comprising a third conductor plate connected to said first end of said first conductor plate and parallel to and spaced from said second conductor plate; and (e) a capacitive feed to said conductor plates.

2. An antenna device as claimed in claim 1 wherein said capacitive feed comprises a fourth conductor plate electrically connected to said second conductor plate and being spaced from and parallel to the first conductor plate at a location between the said first and second ends of said first conductor plate.

3. An antenna device as claimed in claim 2 wherein a dielectric is provided between either said fourth conductor plate and said first conductor plate or between said fourth conductor plate and said second conductor plate.

4. An antenna device as claimed in claim 2 wherein a dielectric is provided between said third conductor plate and said second conductor plate.

5. An antenna device as claimed in claim 1 wherein at least some of said conductor plates are provided with slots.

6. An antenna device, comprising:

(a) a first conductor plate forming a transmission plate and having first and second ends, (b) a second conductor plate disposed below and arranged approximately in parallel with the first conductor plate and forming a ground conductor of the antenna device, (c) means for electrically connecting the first conductor plate with the second conductor plate, and (d) a capacitive load connected between the first end of said first conductor plate and said second conductor plate and comprising a pair of parallel spaced capacitor plates, a first one of said capacitor plates being connected to said first end of said first conductor plate and a second one of said capacitor plates being connected to said second conductor plate.

7. An antenna device as claimed in claim 6 further comprising a capacitive feed.

8. An antenna device as claimed in claim 7 wherein said capacitive feed comprises a conductor plate electrically connected to said second conductor plate and spaced from and parallel to the first conductor plate at a location between the first and second ends of said first conductor plate.

9. An antenna device as claimed in claim 8 wherein a dielectric is provided between either the conductor plate of the capacitive feed and said first conductor plate or between the conductor plate of said capacitive feed and said second conductor plate.

10. An antenna device as claimed in claim 6 wherein a dielectric is provided in the space between said capacitor plates.

11. An antenna device as claimed in claim 6 wherein at least some of said conductor plates are provided with slots.

12. An antenna device, comprising:

(a) a first conductor plate forming a transmission plate and having first and second ends, (b) a second conductor plate disposed below and arranged approximately in parallel with the first conductor plate and forming a ground conductor of the antenna device, (c) means for electrically connecting the first conductor plate with the second conductor plate, (d) a capacitive load connected between the first end of said first conductor plate and said second conductor plate; comprising a plate extending normal to said first conductor plate towards but not reaching said second conductor plate, and (e) a capacitive feed to said conductor plates.

13. An antenna device as claimed in claim 12 wherein said capacitive feed comprises a conductor plate electrically connected to said second conductor plate and spaced from and parallel to the first conductor plate at a location between the first and second ends of said first conductor plate.

14. An antenna device as claimed in claim 13 wherein a dielectric is provided between either the conductor plate of said capacitive feed and said first conductor plate or between the conductor plate of said capacitive feed and said second conductor plate.

15. An antenna device as claimed in claim 12 wherein at least some of the conductor plates are provided with slots.

16. An antenna device, comprising:

(a) a first conductor plate forming a transmission plate and having first and second ends, (b) a second conductor plate disposed below and arranged approximately in parallel with the first conductor plate and forming a ground conductor of the antenna device, (c) means for electrically connecting the first conductor plate with the second conductor plate, (d) a capacitive load connected between the first end of said first conductor plate and said second conductor plate, and (e) a capacitive feed comprising a conductor plate electrically connected to said second conductor plate and spaced from and parallel to the first conductor plate at a location between the first and second ends of said first conductor plate.

17. An antenna device as claimed in claim 16 wherein a dielectric is provided between either the conductor plate of said capacitive feed and said first conductor plate or between the conductor plate of said capacitive feed and said second conductor plate.

* * * * *